US006869175B2

(12) United States Patent
Sinmmachi

(10) Patent No.: US 6,869,175 B2
(45) Date of Patent: Mar. 22, 2005

(54) RECORDING APPARATUS

(75) Inventor: Masaya Sinmmachi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 184 days.

(21) Appl. No.: 10/192,722

(22) Filed: Jul. 11, 2002

(65) Prior Publication Data

US 2003/0011671 A1 Jan. 16, 2003

(30) Foreign Application Priority Data

Jul. 16, 2001 (JP) ..... 2001-215287

(51) Int. Cl.[7] ..... B41J 2/01
(52) U.S. Cl. ..... 347/104
(58) Field of Search ..... 347/104, 16, 106; 271/273; 400/635–641

(56) References Cited

U.S. PATENT DOCUMENTS 5,506,606 A * 4/1996 Saikawa et al. ..... 347/104
5,540,427 A * 7/1996 Nltta et al. ..... 347/104
6,042,112 A * 3/2000 Izumi ..... 271/273
6,105,954 A * 8/2000 Magee et al. ..... 271/273
6,550,907 B2 * 4/2003 Uchida ..... 347/104

FOREIGN PATENT DOCUMENTS

EP 0818320 A2 * 1/1998 ..... 347/104

* cited by examiner

*Primary Examiner*—Thinh Nguyen
*Assistant Examiner*—Julian D. Huffman
(74) *Attorney, Agent, or Firm*—Fitzpatrick, Cella, Harper & Scinto

(57) ABSTRACT

A recording apparatus comprises a transporting roller for contacting the back surface of a recording medium for transporting the recording medium, the contacting and the transporting being effected upstream of a recording head relative to a transporting direction along a recording medium transporting path; a pinch roller which is disposed opposite to the transporting roller with the recording medium transporting path interposed therebetween, and pressed by a pinch roller spring so as to be urged towards the transporting roller, thereby being urged into contact with the recording surface of the recording medium; and a pinch roller holder for rotatably holding the pinch roller. In particular, a pressing position of the pinch roller for pressing the transporting roller is changed by moving the pinch roller holder.

24 Claims, 7 Drawing Sheets

RECORDING APPARATUS

BACKGROUND OF THE INVENTION

1. Field of the Invention

The present invention relates to a recording apparatus for use in information processing apparatuses including a printer, a copy machine, a computer, a word processor, and the like. In particular, this invention relates to a recording apparatus capable of recording high quality images on various kinds of recording mediums.

2. Description of the Related Art

There has been known a recording apparatus which has a plurality of functions so that it can serve as a printer, a copy machine and a facsimile apparatus. There has also been known another recording apparatus which can be used as an output device for a composite electronic apparatus including a computer and a word processor, and can also be used an output device for a work station. Each of these recording apparatus is fabricated so that it can be used to record various kinds of images (characters, marks or the like) on a recording medium such as a recording paper or a thin plastic plate, in accordance with image data provided to the recording apparatus. In fact, the aforesaid recording apparatus may be in any one of the following forms: an ink-jet printer, a wire-dot printer, a thermal printer and a laser beam printer.

Further, in a serial type recording apparatus capable of carrying out a recording process while at the same time performing a main scanning in a direction intersecting a recording medium transporting direction (sub-scanning direction), the recording process (main scanning) is effected by a recording means (a recording head) moving along the recording medium. After the recording along one line on the recording medium is finished, a predetermined amount of paper conveying is performed (which is a pitch transportation acting as a sub-scanning). Subsequently, the recording process (main scanning) along the next line on the same recording medium is performed, thereby completing a desired recording in a desired range on the recording medium by repeating the above recording process. On the other hand, in a line-type recording apparatus in which the recording is performed only by carrying out the sub-scanning of the recording medium, the recording medium is at first set in a predetermined recording position. Then, while the recording along one line is continuously performed as one operation, a predetermined amount of paper conveying (pitch transportation) is performed, thereby completing a desired recording in a desired area on the recording medium.

Among the aforementioned recording apparatus, an ink-jet recording apparatus is formed in such a construction that ink is discharged from a recording means (recording head) towards a recording medium, thereby effecting a desired recording. In fact, such kind of a recording head can be easily made compact, and it is possible to record fine images at a high speed. Therefore, it is possible to use a plain paper as a recording medium without having to perform any special treatment. Further, using an ink-jet recording apparatus makes it possible to reduce running cost, and since an ink-jet recording apparatus employs a non-impact printing manner, an operation noise is low. In addition, another advantage obtainable by employing an ink-jet recording apparatus is that it is possible to use various kinds of inks (such as color inks), thereby making it easy to record various color images.

In fact, using an ink-jet recording apparatus makes it possible to realize the recording of high quality images, by keeping small a distance between a recording head and a recording medium. FIG. 6 is a cross sectional view schematically showing a conventional ink-jet recording apparatus. In FIG. 6, reference numeral 132 represents a recording head for discharging ink onto the recording surface of a recording sheet S, thereby effecting a desired recording on the recording sheet. Reference numeral 123 is a platen for guiding the back surface of the recording sheet S in a position opposite to the recording head 132. Reference numeral 121 represents a transporting roller for contacting the back surface of the recording medium S and thus transporting the same in an area upstream of the recording head 132 along the recording sheet transporting direction. Reference numeral 122 represents a pinch roller which is driven by the transporting roller 121 and thus rotates in contact with the recording surface of the recording sheet S. Reference numeral 141 represents a paper discharge roller for discharging, from the recording apparatus, a recording sheet on which a desired recording has been performed by the recording head 132. Reference numeral 142 represents a driven roller which is rotated by the paper discharge roller 141. Actually, the conventional ink-jet recording apparatus is constructed in such a manner that the recording sheet S may be pressed against the platen 123 by deviating the pinch roller 122 (with respect to the transporting roller 121) towards the downstream side in the recording sheet transporting direction. In this way, it is possible to maintain a small distance or a gap between the recording head 132 and the recording sheet S.

However, the above-described conventional ink-jet recording apparatus has been found to have the following problems. Namely, when a recording sheet is to be fed for recording by the recording head, it is necessary to perform an inclination correction (registration) on the front edge of the recording sheet by bringing the recording sheet to a nip position between the transporting roller 121 and the pinch roller 122. Particularly, in recent years, although there have been produced many kinds of recording mediums which can be used in recording apparatus, some of them fail to be smoothly nipped at the nip position between the two rollers. As a result, some recording sheets will still be inclined or canted, which causes an insufficient nipping of the front edge of the recording sheet. Consequently, it is difficult to transport the recording sheet in a proper manner.

Further, when the rear edge of a recording sheet is deviated from the nip position between the transporting roller 121 and the pinch roller 122, the recording sheet will be kicked away, resulting in a problem that the recording sheet will be transported in a larger amount than predetermined, thus producing a disturbed image.

FIGS. 7A and 7B are explanatory views showing kicking-away of the rear end of the recording sheet. As shown in FIG. 7A, when a recording sheet is being transported, a pressing force for nipping the recording sheet is acting at the nip position between the transporting roller and the pinch roller. When the rear end of the recording sheet is being moved from the nip position, there will be another force sending the recording sheet forward in the recording sheet transporting direction, as shown in FIG. 7B. As a result, the recording sheet will be undesirably sent forward by a larger amount than desired, producing a disturbed image in the rear area of the recording sheet. Here, an amount of kicking-away will be different from one recording sheet to another, depending on the type of each recording sheet, particularly the thickness of each recording sheet. Moreover, even the recording sheets of the same type will still have different kicking-away amounts. For this reason, it is difficult to perform an exact control of the kicking-away amount of each recording sheet, even if such an amount is predicted in advance and the recording operation is controlled.

SUMMARY OF THE INVENTION

The present invention can provide an improved recording apparatus which enables each recording medium to have an improved registerability as well as an improved transportability, using a simplified structure, thereby making it possible to record various high quality images.

The present invention can provide an improved recording apparatus for performing recording on the recording surface of a recording medium. The recording apparatus comprises a transporting roller for contacting the back surface of the recording medium for transporting the recording medium in a transporting direction, the contacting and the transporting being effected upstream of the recording head, relative to the transporting direction, along the recording medium transporting path; a pinch roller which is disposed opposite to the transporting roller with the recording medium transporting path interposed therebetween, and pressed by a pinch roller spring (or urging means) so as to be urged towards the transporting roller, thereby being brought into contact with the recording surface of the recording medium; and a pinch roller holder for rotatably holding the pinch roller. In particular, a pressing position of the pinch roller for pressing the transporting roller is changed by moving the pinch roller holder.

The present invention can also provide an improved recording device for performing recording on the recording surface of a recording medium with a recording head. The device includes a transporting roller, a pinch roller and a pinch roller holding arm. The transporting roller contacts the back surface of the recording medium for transporting the recording medium in a transporting direction, the contracting and the transporting being effected upstream of the recording head, relative to the transporting direction, along the recording medium transporting path. The pinch roller is disposed opposite to the transporting roller with the recording medium transporting path interposed therebetween, and pressed by a pinch roller spring towards the transporting roller, thereby being brought into contact with the recording surface of the recording medium. The pinch roller holding arm rotatably holds the pinch roller and is movable about a pivot axis. A pressing position of the pinch roller for pressing the transporting roller is changed by moving the pivot axis of the pinch roller holding arm.

Further objects, features and advantages of the present invention will become apparent from the following description of the preferred embodiments with reference to the attached drawings.

DESCRIPTION OF THE PREFERRED EMBODIMENTS

In the following, the preferred embodiments of the present invention will be described in detail with reference to the accompanying drawings.

First Embodiment

Figure 1:
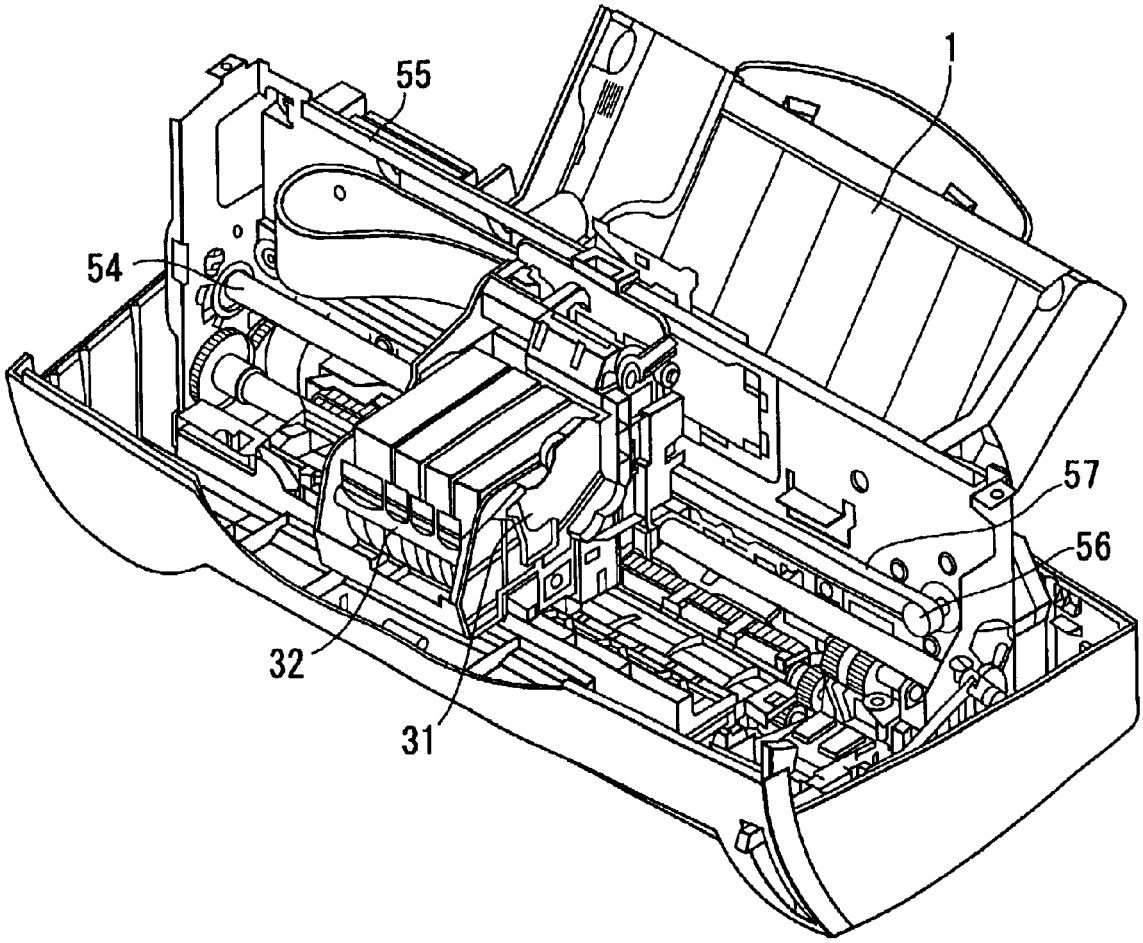
FIG. 1 is an external perspective view schematically showing an entire structure of an ink-jet recording apparatus formed according to the first embodiment of the present invention.
Figure 2:
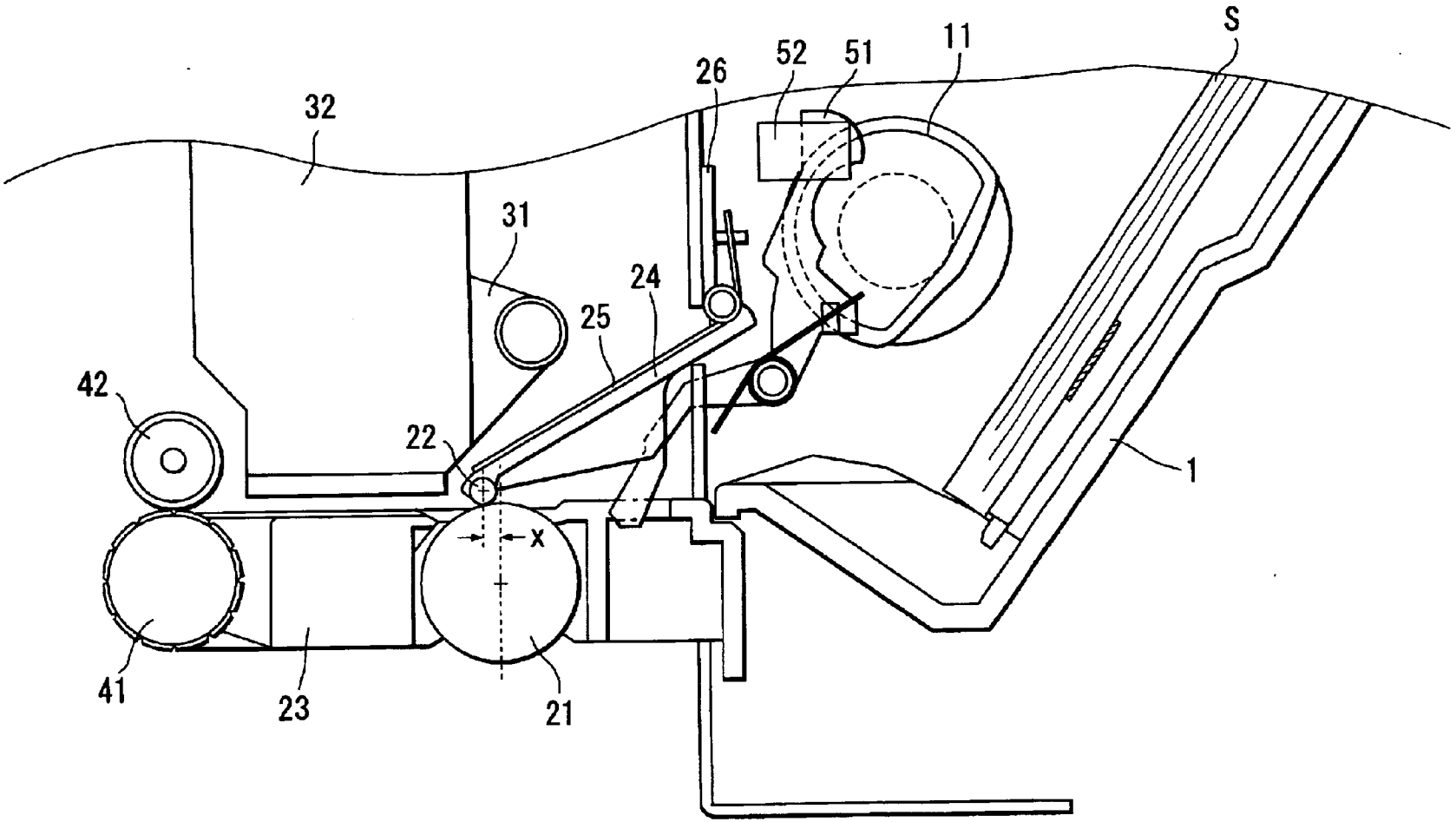
FIG. 2 is a cross-sectional view schematically showing a transporting section of the ink-jet recording apparatus formed according to the first embodiment of the present invention, illustrating a condition in which a relatively thin recording medium such as a plain paper is being transported.
Figure 3:
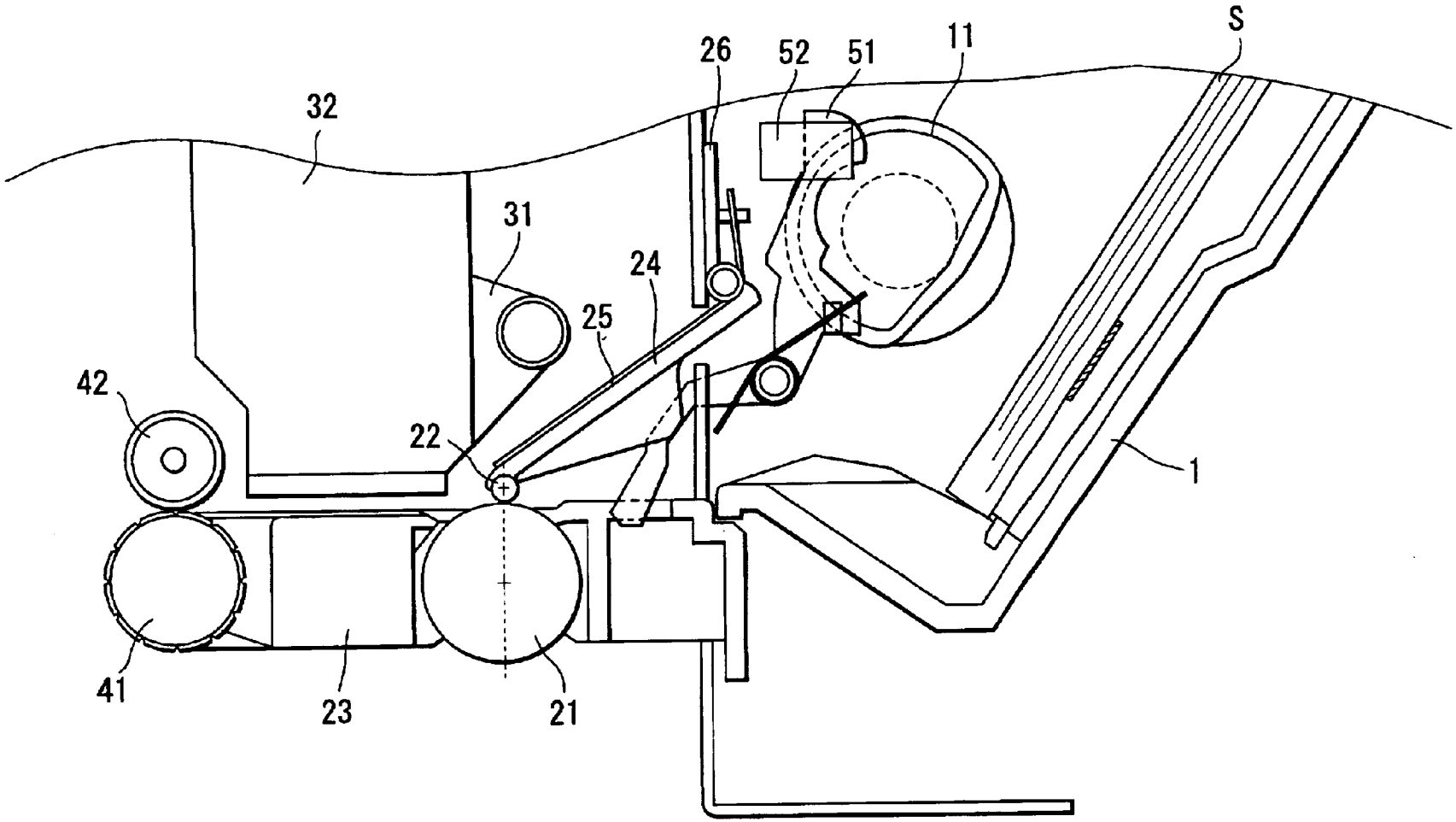
FIG. 3 is another cross-sectional view schematically showing the transporting section of the ink-jet recording apparatus formed according to the first embodiment of the present invention, illustrating a condition in which a relatively thick recording medium, such as a post card or an envelope, is being transported.

FIGS. 1 to 4 are explanatory views schematically showing a first embodiment of the present invention. In more detail, FIG. 1 is an external perspective view schematically showing an entire structure of an ink-jet recording apparatus formed according to the first embodiment of the present invention. FIG. 2 is a cross-sectional view schematically showing a transporting section of the ink-jet recording apparatus, illustrating a condition in which a relatively thin recording medium such as a plain paper is being transported. FIG. 3 is another cross-sectional view schematically showing the transporting section of the ink-jet recording apparatus, illustrating a condition in which a relatively thick recording medium, such as a post card or an envelope, is being transported.

Referring to FIGS. 1 and 2, a plurality of recording sheets S mounted on an automatic paper feeder 1 are separated one by one through the rotation of a section within the recording apparatus. Once the front end of each recording sheet S transported by the feeding/sending roller 11 comes into contact with a PE sensor lever 51 and thus causes the PE sensor lever to have a pivotal movement, a PE sensor 52 will operate to detect the position of the front end of the recording sheet S. Reference numeral 21 represents a transporting roller which comes into contact with the back surface of the recording sheet so as to transport the recording sheet, in an area upstream of a recording head 32 relative to the sheet transporting direction. Reference numeral 22 represents a pinch roller which is driven by the transporting roller 21, and is caused to come into contact with the recording surface of the recording sheet (with itself being rotated). In this way, once the front end of the recording sheet S is detected, the recording sheet S will be moved by a predetermined amount. At this time, by bringing the recording sheet S into a nip position between the transporting roller 21 and the pinch roller 22, it is possible to effect a registration on the recording sheet. Further, reference numeral 24 represents a pinch roller holder for rotatably holding the pinch roller 22. Reference numeral 25 represents a pinch roller spring constantly urging the pinch roller holder 24. By virtue of such an urging force, the pinch roller 22 will be exactly pressed against the transporting roller 21. Reference numeral 26 represents a changeover plate, which can move the pinch roller holder 24 in an upward/downward direction and which can be moved by a lever (not shown). After the registration has been effected on the recording sheet S, the recording sheet S is transported to a position opposite to the recording head on a platen 23, by virtue of rotation of the transporting roller 21 and the pinch roller 22.

Then, on the recording sheet S, which has been transported to the position opposite to the recording head 32, a recording operation is performed by means of the recording head 32 mounted on a carriage 31. After the recording operation is finished, the recording sheet S is discharged out of the recording apparatus by being pinched between a paper discharge roller 41 and a driven roller 42 (which is driven by the discharge roller 41) and forwardly conveyed.

The carriage 31 is guided by a guide shaft 54 as well as a guide rail 55, and driven by a driving force produced by a carriage motor 56 and transmitted through a timing belt 57.

However, if the recording sheet S to be transported is a relatively thin recording medium such as a plain paper, the changeover plate 26 is moved to its lower position and the pinch roller 22 will be offset by a deviation x with respect to the transporting roller 21 in the recording sheet transporting direction, as shown in FIG. 2. In this way, it is possible to inhibit deformation of the recording sheet (such deformation being caused by absorption of ink, for example), thereby maintaining a constant distance or gap between the recording sheet S and the recording head 32.

On the other hand, if the recording sheet S to be transported is a relatively thick recording medium, such as a post card or an envelope, the changeover plate 26 is moved to its upper position and the pinch roller 22 will not be offset with respect to the transporting roller 21 in the recording sheet transporting direction, as shown in FIG. 3. In this way, it is possible to ensure that the recording sheet can be properly nipped at the nip position between the transporting roller 21 and the pinch roller 22.

Figure 4B:
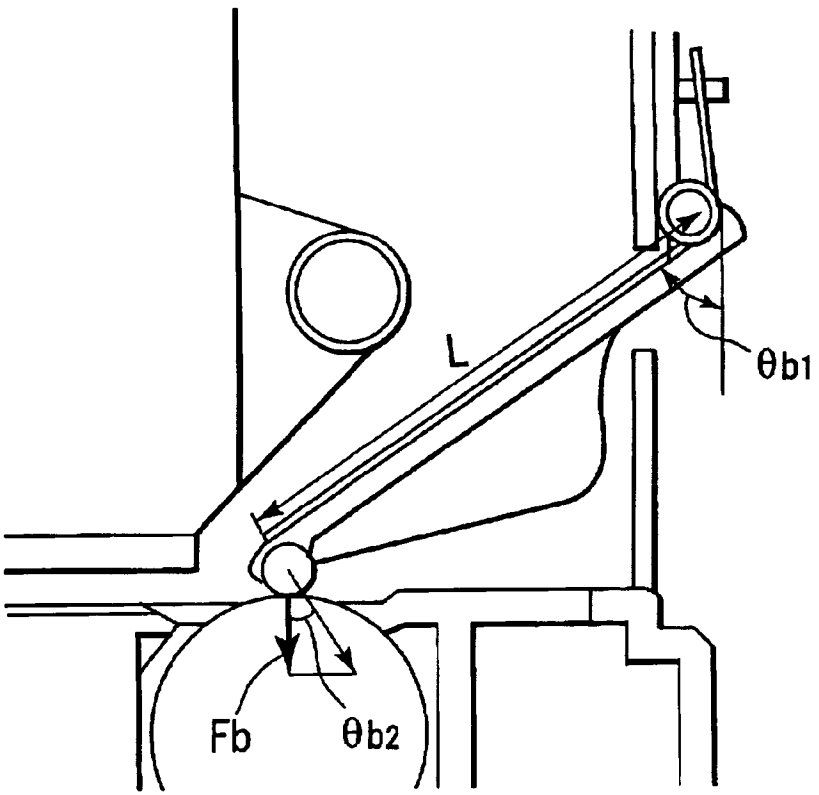
FIGS. 4A and 4B are explanatory views schematically showing a pressing force produced by a pinch roller against a transporting roller.
Figure 4A:
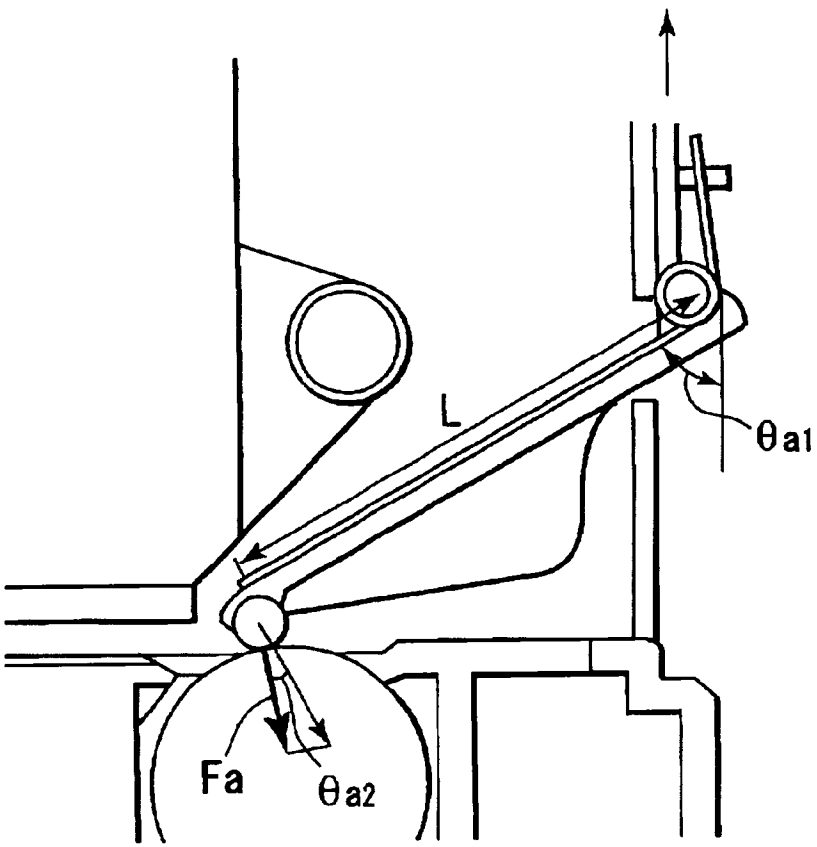

Accordingly, whenever the position of the pinch roller 22 is changed over by moving the changeover plate 26, a pressing force of the pinch roller 22 acting on the transporting roller 21 will also be changed. FIGS. 4A and 4B are explanatory views schematically showing a pressing force produced by the pinch roller and acting on the transporting roller. In more detail, FIG. 4A shows a condition in which the pinch roller 22 has been offset in the transporting direction with respect to the transporting roller 21, while FIG. 4B shows a condition in which the pinch roller 22 has not been offset in the transporting direction with respect to the transporting roller 21.

Here, if Fa is a pressing force when the pinch roller 22 has been offset, Fb is a pressing force when the pinch roller 22 has not been offset, and k is a spring constant of the pinch roller spring 25, the following equations are established:

$$Fa=k\times\theta a1/L\times\cos\theta a2$$

$$Fb=k\times\theta b1/L\times\cos\theta b2$$

$$Fa:Fb=\theta a1\times\cos\theta a2:\theta b1\times\cos\theta b2$$

Here, since $\theta a1>\theta b1$ and $\cos\theta a2>\cos\theta b2$, the result will be Fa>Fb. For this reason, when a relatively thick recording medium is being transported, the pinch roller 22 has only a relatively weak pressing force, thereby ensuring an improved pinching force which is appropriate for pinching a relatively thick recording medium between the pinch roller and the transporting roller.

According to the above-described arrangement, since a pressing position of the pinch roller pressing the transporting roller can be changed corresponding to the kind of a recording medium, it is possible to provide an improved recording apparatus which enables each recording medium to have an improved registerability as well as an improved transportability, using only a simplified structure, thereby making it possible to record various high quality images.

Second Embodiment

Figure 5:
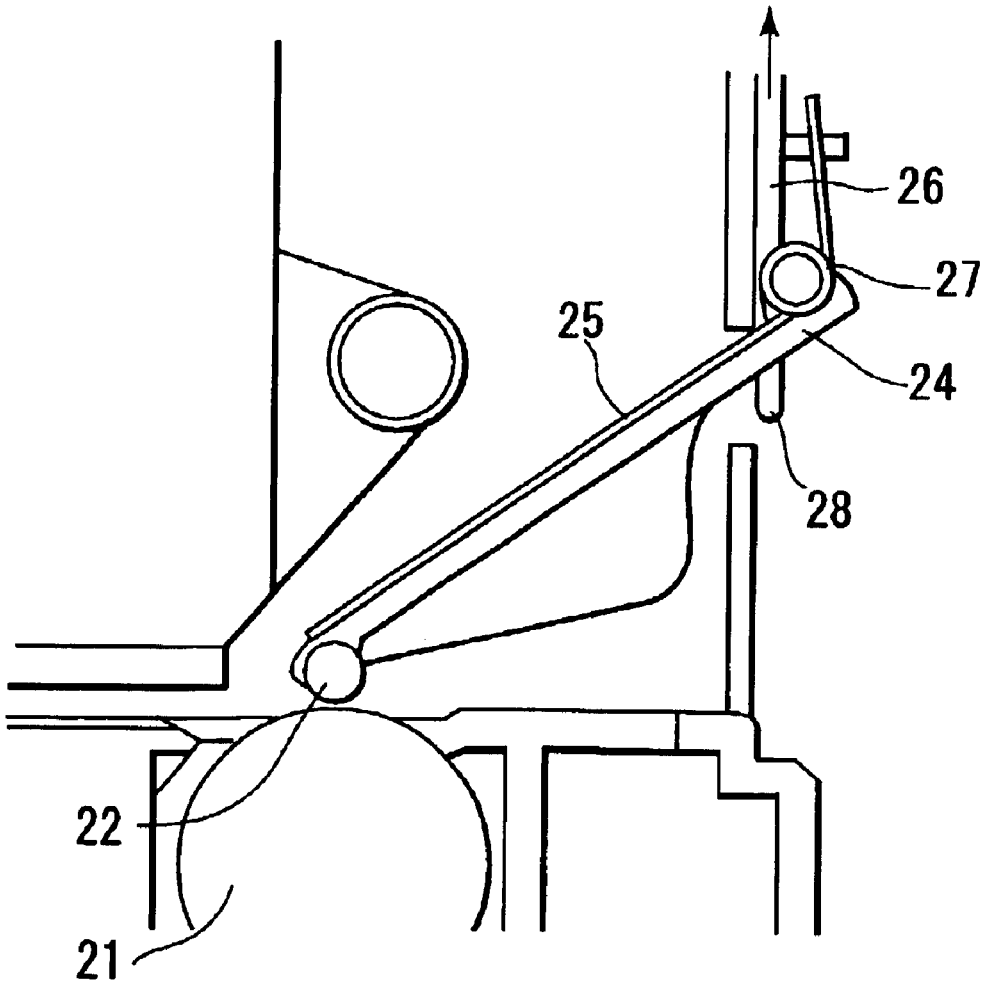
FIG. 5 is a cross-sectional view schematically showing a recording sheet transporting section of a recording apparatus formed according to a second embodiment of the present invention, illustrating a condition in which a pinch roller has been separated from a transporting roller.
Figure 6:
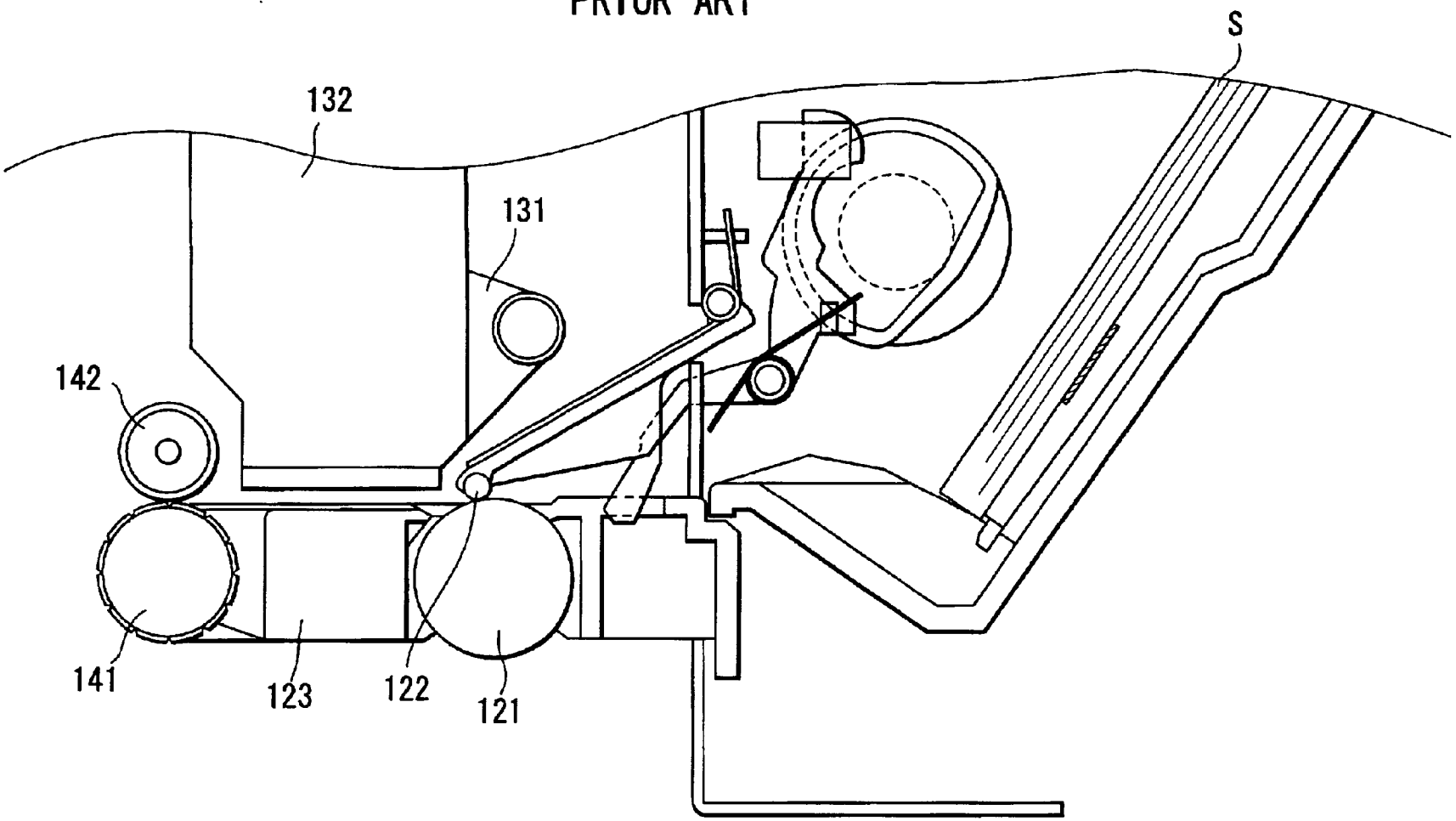
FIG. 6 PRIOR ART
FIG. 6 is a cross-sectional view schematically showing a conventional ink-jet recording apparatus.
Figure 7A:
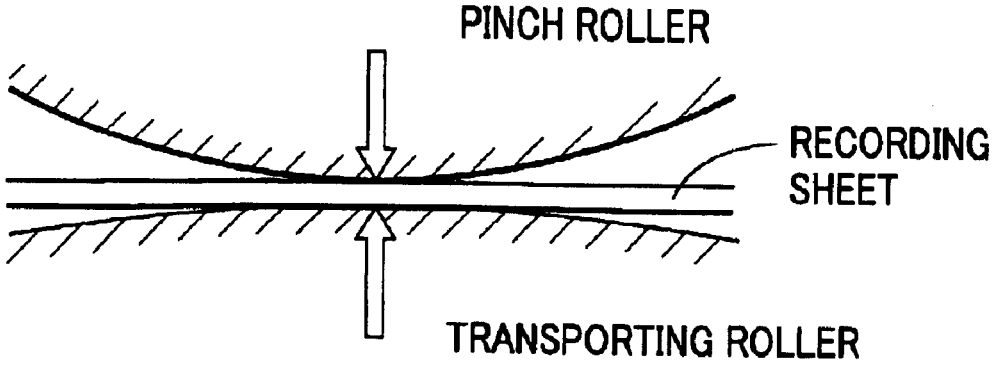
FIGS. 7A and 7B are explanatory views schematically showing how the rear end of a recording sheet will be kicked away.
Figure 7B:
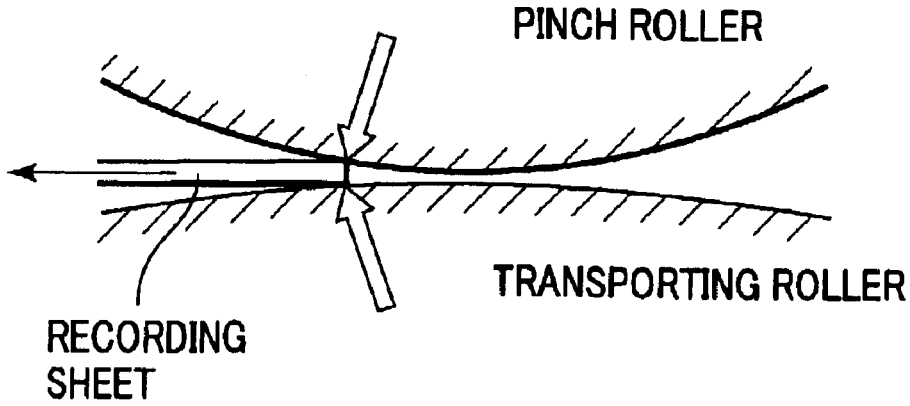

The second embodiment of the present invention will be described in the following with reference to FIG. 5. In contrast to the above-described first embodiment in which a pressing position of the pinch roller 22 is changed-over by a lever corresponding to the kind of a recording sheet, the second embodiment is directed to an arrangement in which the pressing position of the pinch roller is automatically changed-over, and such changeover is effected when transporting each one sheet of recording medium. Namely, the position of the changeover plate 26 is automatically changed by a driving system including a motor and a plunger (not shown), so that when the registration and recording are performed on the recording sheet and when the rear end of the recording sheet is about to exit the nip position between the pinch roller and the transporting roller, the pressing position of the pinch roller will be properly changed over.

For instance, when a recording sheet such as a plain paper is being transported and when the registration is effected on the recording sheet, the recording sheet will be in a position shown in FIG. 4B, thereby improving the registration effect on the recording sheet. Then, during the recording, the recording sheet will be in a position shown in FIG. 4A. At this time, the recording sheet is pressed against the platen 23, while a predetermined distance is maintained between the recording sheet and the recording head, thereby ensuring the recording of an image having a high quality. Then, when the rear end of the recording sheet is about to exit the nip position between the pinch roller and the transporting roller, the recording sheet will be in a position shown in FIG. 4B, thereby preventing the recording sheet from being kicked away. Further, it is also possible to form such an arrangement that when the rear end of the recording sheet is about to exit the nip position between the pinch roller and the transporting roller, the pinch roller 22 will be separated from the transporting roller 21, thereby absolutely preventing the recording sheet from being kicked away.

According to the arrangement described above, since it is possible to change the pressing position of the pinch roller when transporting one recording sheet, it is possible to provide an improved recording apparatus which enables each recording medium to have an improved registerability as well as an improved transportability, using only a simplified structure, thereby making it possible to record various high quality images.

Although each of the above-described embodiments has shown the present invention being applied to a serial-type recording apparatus in which the recording head is moved in the main scanning direction, the present invention can also be applied to a full-line type recording apparatus having a recording head extending across the entire width of a recording sheet, capable of recording an image by the recording head when the recording sheet is being continuously transported.

Further, although each of the above embodiments has been described based on an example of using a bubble jet recording head, which is one of various types of ink jet heads, the present invention should not be limited to the above-described recording head. Rather, the present invention can also be applied to various other types of recording heads. For example, a piezo-electric ink-jet recording head can be used. Further, instead of using an ink-jet head, recording heads equipped with one of various other recording elements, such as thermal transfer recording elements, can be used.

As described above, according to the present embodiment, by moving the pinch roller holder, which can rotatably hold the pinch roller, it is possible to change a pressing position of the pinch roller pressing against the transporting roller. Therefore, it is possible to provide an improved recording apparatus which enables each recording medium to have an improved registerability as well as an improved transportability, using only a simplified structure, thereby making it possible to record various high quality images.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus for performing a recording operation on the recording surface of a recording medium with recording means, comprising:

a transporting roller for contacting the back surface of the recording medium in a transporting direction, the contacting and the transporting being effected upstream of the recording means, relative to the transporting direction, along the recording medium transporting path;

a pinch roller which is disposed opposite to said transporting roller with the recording medium transporting path interposed therebetween, and pressed by an urging means so as to be urged towards the transporting roller, thereby being brought into contact with the recording surface of the recording medium; and pinch roller holding means for rotatably holding the pinch roller, said pinch roller holding means having a base and a pivot axis at said base, wherein a pressing position of said pinch roller for pressing the transporting roller is changed by changing the position of the pivot axis of said pinch roller holding means.

2. A recording apparatus according to claim 1, wherein the pressing position of said pinch roller for pressing said transporting roller is changed corresponding to the type of recording medium being transported.

3. A recording apparatus according to claim 2, wherein when a relatively thin recording medium such as a plain paper is being transported, said pinch roller is offset from said transporting roller relative to the transporting direction.

4. A recording apparatus according to claim 2, wherein when a relatively thick recording medium such as a post card or an envelope is being transported, said pinch roller is not offset from said transporting roller relative to the transporting direction.

5. A recording apparatus according to claim 1, wherein said pinch roller holding means is moved manually.

6. A recording apparatus according to claim 1, wherein said pinch roller holding means is moved automatically.

7. A recording apparatus according to claim 6, wherein the pressing position of said pinch roller for pressing the transporting roller is changed at least once during a process in which one sheet of recording medium is being transported.

8. A recording apparatus according to claim 7, wherein said pinch roller is positioned in i) a first pressing position before the one sheet of recording medium is nipped between said transporting roller and said pinch roller and ii) a second pressing position after the one sheet of recording medium is nipped between said transporting roller and said pinch roller.

9. A recording apparatus according to claim 7, wherein said pinch roller is positioned in i) a first pressing position while the one sheet of recording medium is being nipped between said transporting roller and said pinch roller and ii) a second pressing position while the one sheet of recording medium is exiting the nip between said transporting roller and said pinch roller.

10. A recording apparatus according to claim 1, wherein the pressing force of said pinch roller acting on said transporting roller varies corresponding to a change in the pressing position of said pinch roller when said pinch roller is pressing said transporting roller.

11. A recording apparatus according to claim 1, wherein the recording means comprises an ink-jet recording head capable of discharging ink.

12. A recording apparatus according to claim 11, wherein the ink-jet recording head comprises an electrothermal converter for generating heat energy for use in discharging the ink.

13. A recording apparatus for performing a recording operation on the recording surface of a recording medium with recording means, comprising:

a transporting roller for contacting the back surface of the recording medium for transporting the recording medium in a transporting direction, the contacting and the transporting being effected upstream of the recording means, relative to the transporting direction, along the recording medium transporting path;

a pinch roller which is disposed opposite to said transporting roller with the recording medium transporting path interposed therebetween, and pressed by a pinch roller spring towards the transporting roller, thereby being brought into contact with the recording surface of the recording medium; and a pinch roller holding arm for rotatably holding the pinch roller, said pinch roller holding arm being movable about a pivot axis, wherein a pressing position of said pinch roller for pressing the transporting roller is changed by changing the position of the pivot axis of said pinch roller holding arm.

14. A recording apparatus according to claim 13, wherein the pressing position of said pinch roller for pressing said transporting roller is changed corresponding to the type of recording medium being transported.

15. A recording apparatus according to claim 14, wherein when a relatively thin recording medium such as a plain paper is being transported, said pinch roller is offset from said transporting roller relative to the transporting direction.

16. A recording apparatus according to claim 14, wherein when a relatively thick recording medium such as a post card or an envelope is being transported, said pinch roller is not offset from said transporting roller relative to the transporting direction.

17. A recording apparatus according to claim 13, wherein the pivot axis of said pinch roller holding arm is moved manually.

18. A recording apparatus according to claim 13, wherein the pivot axis of said pinch roller holding arm is moved automatically.

19. A recording apparatus according to claim 18, wherein the pressing position of said pinch roller for pressing the transporting roller is changed at least once during a process in which one sheet of recording medium is being transported.

20. A recording apparatus according to claim 19, wherein said pinch roller is positioned in i) a first pressing position before the one sheet of recording medium is nipped between said transporting roller and said pinch roller and ii) a second pressing position after the one sheet of recording medium is nipped between said transporting roller and said pinch roller.

21. A recording apparatus according to claim 19, wherein said pinch roller is positioned in i) a first pressing position while the one sheet of recording medium is being nipped between said transporting roller and said pinch roller and ii) a second pressing position while the one sheet of recording medium is exiting the nip between said transporting roller and said pinch roller.

22. A recording apparatus according to claim 13, wherein the pressing force of said pinch roller acting on said transporting roller varies corresponding to a change in the pressing position of said pinch roller when said pinch roller is pressing said transporting roller.

23. A recording apparatus according to claim 13, wherein the recording head comprises an ink-jet recording head capable of discharging ink.

24. A recording apparatus according to claim 23, wherein the ink-jet recording head comprises an electrothermal converter for generating heat energy for use in discharging the ink.

* * * * *

UNITED STATES PATENT AND TRADEMARK OFFICE

CERTIFICATE OF CORRECTION

PATENT NO. : 6,869,175 B2
DATED : March 22, 2005
INVENTOR(S) : Shimmachi

It is certified that error appears in the above-identified patent and that said Letters Patent is hereby corrected as shown below:

Title page,
Item [56], References Cited, U.S. PATENT DOCUMENTS,
"Nltta et al." should read -- Nitta et al. --.

Signed and Sealed this

Sixth Day of December, 2005

JON W. DUDAS
*Director of the United States Patent and Trademark Office*